United States Patent [19]

Aurness et al.

[11] Patent Number: 4,872,326

[45] Date of Patent: Oct. 10, 1989

[54] THREE STAGE COMBINATION REPLACEMENT LOCK

[76] Inventors: Harold O. Aurness; Thomas G. Mahler, both of 5808 Knox Ave. N., Brooklyn Center, Minn. 55430

[21] Appl. No.: 130,894

[22] Filed: Dec. 10, 1987

[51] Int. Cl.[4] ..... E05B 65/06

[52] U.S. Cl. ..... 70/133; 70/150; 70/312

[58] Field of Search ..... 70/312, 3–4, 70/69–71, 133, 150, 153, 73

[56] References Cited

U.S. PATENT DOCUMENTS

| | | | |
|---|---|---|---|
| 4,231,597 | 11/1980 | Pelcin | 70/150 |
| 4,249,469 | 2/1981 | Craske | 70/312 |
| 4,279,136 | 7/1981 | Milles | 70/312 |
| 4,281,525 | 8/1981 | Bako | 70/312 |

*Primary Examiner*—Robert L. Wolfe

[57] ABSTRACT

A three stage lock unit according to the teachings of the preferred embodiment of the present invention is shown as including a patented combination lock secured within an outer housing of the lock unit which is secured to a mail box door or any small door. Combined with the combination lock is a push button constrained by the combination lock until the correct lock combination is dialed releasing an arm of the push button placed to utilize a hole in the door previously used for another type of lock. The push button arm extends inward to an inner housing to contact the sliding spring mounted door latch within a slot of the latch and opens the unit door when pushed inwardly. A spring activated pin within the door latch extending into the slot to meet the push button arm helps to close the system smoothly by providing an auxiliary force through pressure on the push button arm to relatch with the combination lock latch. In addition, latch handle is provided in the inner housing to be used by service personnel to open the door from the inside for resetting the combination lock. To reset the combination lock dials push buttons are provided as an improvement over a pin type tool normally used to set the lock.

9 Claims, 1 Drawing Sheet

THREE STAGE COMBINATION REPLACEMENT LOCK

Figure 1:
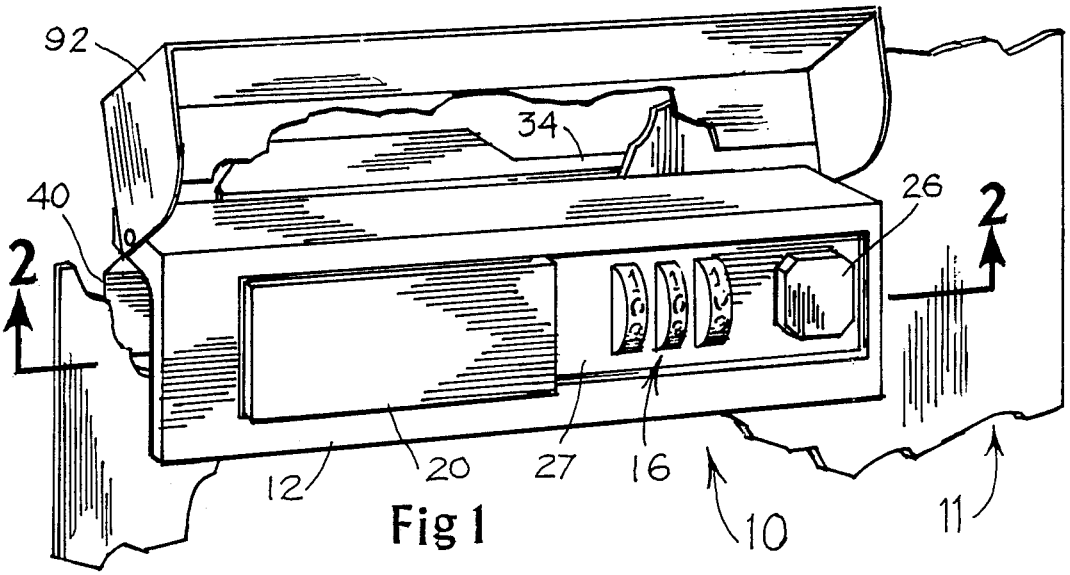
Figure 2:
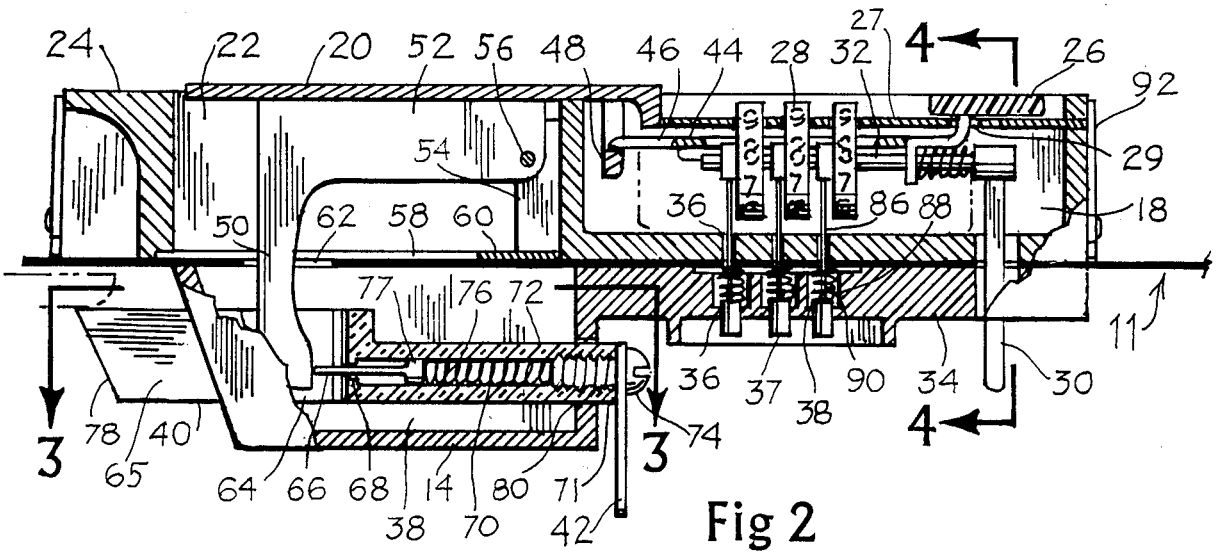
Figure 3:
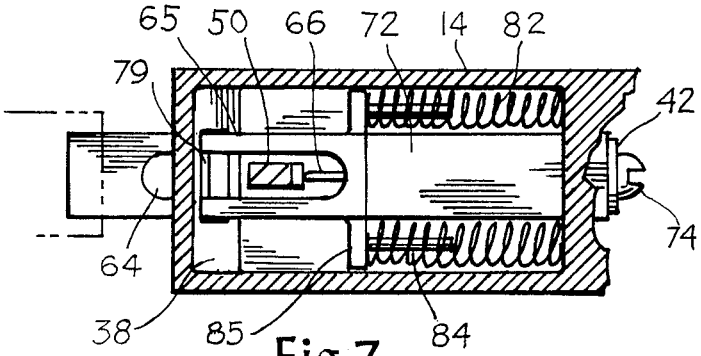
Figure 4:
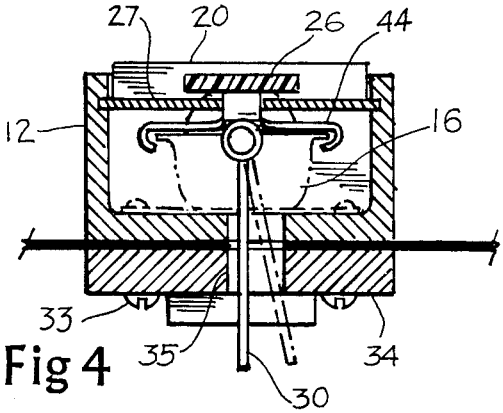

The present invention relates generally to replacing a key type lock with a compatibly designed combination lock.

The increasing problem of changing locks on mail box doors due to moving tenants and lost keys has become costly and wasteful.

SUMMARY

The present invention solves this problem by providing, in the preferred embodiment, a replacement lock of three stages to secure of a mail box door which was previously secured by a key type lock. Specifically, a patented combination lock comprising three dials, a center shaft and a latch connected to a release button is incorporated into an outside housing which also holds a swivally mounted push button with a catch that is hooked by the combination lock latch. When the push button catch is released after the combination lock has been dialed and the release button pushed, the push button can be pressed to activate a push button arm extending inwardly through a hole in the mail box door previously occupied by a key type lock but which is too small for the patented combination lock to use. The push button arm reaches to a sliding door latch in an inside housing, which is constrained from opening by side springs, to an inside face of a horizontal slot in the door latch wherein it pushes back the latch to open the door when activated.

The present invention solves this problem by providing in the preferred embodiment a means for latching the door and relatching the push button in the outside housing without having to use excessive force by the user. Specifically, a spring activated pin is slideably mounted horizontally in a chamber within the inner end of the door latch with one end outside the chamber pressed against the edge of the push button arm and the other, flanged, end pressed against the spring inside the chamber. The spring pressure on the flange of the pin is adjusted by an adjusting screw with access outside the inner end of the latch. When the door latch returns to its normal, closed position, whether the door is closed or not, the pin, as an auxiliary, supplemental force, helps the push button catch, in the outside housing, to force itself past the combination lock latch, which then slides over it, thereby putting the unit in a closed mode. This enables the door to be closed easily and quietly and to be kept in adjustment.

The present invention solves this problem by providing, in the preferred embodiment, means for easily setting or resetting the combination lock dials. Specifically, three spring activated push buttons on shafts extend from the reset mechanism of the dials near the center shaft of the lock inward through three holes drilled in the door to the inside housing. They replace an adjustment tool used to set each dial and was difficult to use. The dials are first neutralized for resetting by a shift handle which also extends inwardly through a drilled hole in the door to the inside housing.

The present invention solves this problem by providing, in the preferred embodiment, means for opening the door of the mail box from the inside by service personnel gaining entrance through a service door in the back in order to make the reset means available to a new user. Specifically, a handle attached by means of the spring adjusting screw on the inner end of the door latch allows the operator to merely pull the latch open to open the door.

It is an object of this invention to provide a means to replace a usual key type lock with a complex combination lock system in a mail box door using the same hole in which the key type locks resided but which is too small for the combination lock to use thus eliminating the need to replace the door also.

It is also an object of this invention to provide a means for reusing the same locking system by different users by the employment of combination dials for resetting the lock.

It is also the object of this invention to provide a lock which makes the door easy to open and close making for less wear on the lock system.

It is also an object of this invention to provide a means for easy changing of the combination of the combination lock.

DESCRIPTION

A combination lock unit is generally known in the drawings and generally designated 10. Unit 10 is designed to be installed on a vertical metal door previously hosting a lock of another type and generally designated 11. Unit 10 generally includes an outside housing 12 of rectangular shape mounted on the outside of the door 11 and an inside housing 14 of rectangular shape mounted on the outside of the door 11 opposite the outside housing 12. Outside housing 12 includes a patented combination lock 16 centered and secured in a rectangular space 18 at one end of the unit 10; a rectangular push button 20 covering a rectangular well space 22 tandem to a pull handle 24 at the other end of the housing 12; a sliding latch lock button 26, as part of the combination lock 16, centered horizontally over an outer end of a cover plate 27 covering the combination lock installation 16 with openings for the dials 28 and an opening 29 for the latch lock button 26; a top portion of a shift handle 30, as part of the combination lock 16, attached to the axle 32 of the combination lock 16.

Inside housing 14, secured to door 11 and outside housing 12 by screws 33, features a rectangular housing plate 34 at one end opposite the rectangular space 18 of outside housing 12 with an opening 35 for the shift handle 30 and holes 36 for three reset buttons 37 extending inwardly from the combination lock 16; a door latch chamber 38 tandem and joined to the housing plate 34 holding the slideable door latch 40 and the latch release handle 42.

When combination lock 16 is correctly dialed according to a preset combination of three numbers to open door 11, it releases the latch lock button 26 connected to a spring-constrained sliding frame 44 circumscribing the combination lock dials 28. Sliding frame 44, which is part of the combination lock 16, becomes a latch 46 at its other end and holds the latch lock catch 48, connected to the underside of the push button 20, in a lock position until withdrawn allowing the push button 20 to be activated. Latch 46 resumes its former relative position after the latch lock catch 48 has moved outward in response to hand action and after the latch lock button 26 has been released.

When push button 20 is pressed to open door 11 it activates an attached push button arm 50 extending inward from a bracing member 52 running horizontal along, and attached to, the center of the underside of push button 20 to a position between two wall abutments 54 through which a pin 56 secures the bracing member pivotally. Push button arm 50 extends inwardly to the door latch chamber 38 of the inside housing 14 through a slot 58 of a guide plate 60 positioned above an opening 62 in the door 11 previously used for another type of lock.

Push button arm 50, profiled on its contact edge to cause a smooth lock action and to clear the old opening 62 in the door 11 on its inward path, continues on to enter an elongated latch slot 64 in an outer half 65 of the door latch 40 to contact a sliding pin 66 protruding from an opening 68 in the outer end of a spring chamber 70 traversing horizontally through an inner half 72 of the door latch 40. A spring adjusting screw 74, threaded through the latch release handle 42 is also threaded into the end of the spring chamber 70, at the inner end 71 of the door latch 40, and blocks a spiral pin spring 76 at that end traversing the spring chamber 70. Spiral spring 76 abuts the flanged head 77 of the sliding pin 66 at the other end of the spring chamber 70.

Door latch 40, which has a generally rectangular perimeter and typical, beveled contact end 78, has its beveled end 78 extending through rectangular opening 79 in the lateral outer end of door latch chamber 38 and its other, inner, end 71 extending through opening 80 at the other end of door latch chamber 38. Door latch 40 is diminished in its inner half 72 to approximately one-half its horizontal thickness to be able to clear the housing plate 34 as it passes out the inner end of door latch chamber 38.

Door latch 40 is held in normal latched, or locked, position by spiral springs 82 aligned on either horizontal side of the diminished inner half 72 of the door latch 40 and held in parallel spaced relation by spring holders 84 extending part way through the spiral springs 82 from the center of vertical wing walls 85 protruding from the horizontal sides of the door latch 40 at a central point.

When push button 20 is released from hand pressure after opening the door 11, the door latch 40 returns to its normal latched, or locked, position forcing the latch lock catch 48 past the latch 46, which is connected to the sliding frame 44, until the spring activated latch 46 slides back over the lip of the latch lock catch 48. The door 11 can then be pushed shut, automatically latching, but not locking it until the dials 28 have been spun.

The patented combination lock 16 is reset by three reset buttons 37 on connecting shafts 86 to dials 28 through a row of aligned access holes 36 in outside housing 12 and inside housing 14. Access holes 36 feature spring chamber wells 88, an enlarged diameter of the access holes 36 extending from the side of the inside housing 14 which is attached to the door 11, holding spiral spring 90 which keep the reset buttons 36 and shafts 86 from contact with the resetting mechanism in the combination lock dials 28 until needed. Before the combination lock 16 can be reset, the shift handle 30, which is part of the combination lock 16 and connected to the combination lock central axle 32 and extends through opening 35 to the inside housing 14, must be turned to a neutral position.

The third stage of the combination lock of unit 10, which involves the action of the door latch 40, is enhanced by the action of the sliding pin 66, impelled by the pin spring 76, which relieves the spiral spring 84 at the sides of the door latch 40, from the burden of providing all the force necessary to close both the door latch 40 and the push button 20. This makes for a quiet, firm closing of the door 11 with adjustment of the system possible by the presence of the spring adjusting screw 74.

It can be appreciated that the present invention consists of three stages in order to make use of an access hole 62 previously used for another type of lock, but too small for a normal combination lock of adequate size. The three stage lock 10 can replace the old lock, with the addition of five drilled holes in door 11 and, in so doing, prevent further repeated replacement of the old locks made useless by the loss of their keys. Further improvement is achieved by the easier changing, or resetting, of the combination dials 28 by push type reset buttons 37 and the ability of the door latch 40 to be released from inside by the simple pulling of the latch release handle 42 by service personnel to change the combination.

A protective cover 92 is swivelly attached at the top of unit 10.

We claim:

1. In a lock unit comprising a three-stage system for use on a small, hinged door utilizing an old access hole, the three stages being: (1) dialing a combination lock which releases; (2) a sliding latch lock to be pushed which releases; (3) a push button which activates a door latch; an outer housing comprising in combination a patented combination lock comprising dials, inwardly extending reset buttons and reset arm, a latch lock button added to the sliding latch lock for easier use in opening the system after the lock is correctly dialed, a swivally attached push button tandem to the combination lock with a catch held in locked contact by the sliding latch of the combination lock, with an arm of the push button extending inwardly from the outer housing through a small rectangular door plate hole previously used for another type of lock, to a door latch chamber in an inside housing to contact the end of a spring controlled sliding push pin horizontally placed within a slot in the door latch; wherein the improvement is in the utilization of the small door plate hole, which is too small for a combination lock installation, for access to the door latch and push pin by the push button arm with the addition of two screw holes in the door plate to hold the housings to the door; with further improvement comprised of the said inside housing comprising of a housing plate opposite the combination lock with additional holes made in the door plate for the reset arm and the combination lock reset buttons which extend inwardly through the door plate and are used to neutralize the combination lock and change the combination respectively; a door latch chamber opposite the push button, containing the door latch which extends laterally through both ends of the chamber, with a slot through the outer half of the latch to accommodate the push button arm which contacts the sliding push pin and the inside face of the latch slot to push back the door latch which is contained from sliding open from the normal lock position by spring means on either side of the door latch and blocked by the end wall of the latch chamber; with further improvement combining a handle means for opening the door latch from the inside with a screw means for adjusting the pressure of the spring activated sliding push pin in the inner half of the door latch, which automatically returns the push button to a desired flush position, latched and locked, in the outside housing; with further improvement provided by the addition of spring biased push buttons at each dial of the patented combination lock for easier resetting; a cover hinged on the outside of the unit for protection from the weather.

2. The lock unit of claim 1 wherein the latching locking means comprises in combination, a patented combination lock having a slideable latch member; a latch catch member of a push button which is swivably attached to the unit housing tandem to the combination lock; a push button arm extending in an oppositional angle from the push button to reach a spring operated door latch; wherein when the slideable latch member, released by dialing the combination lock, is moved off the latch catch, the push button is freed to be activated to contact and open the door latch through the reach of the push button arm.

3. The lock unit of claim 1 wherein the latching action is enhanced by the addition of a sliding pin with a flanged head and a shank; with the flanged head abutting an expansion spring placed in an elongated horizontal chamber within an inner end of the door latch, the door latch being activated by springs on two opposite horizontal sides; with the shank of the sliding pin extending through a small opening in the center of the end of the chamber near the lateral center of the latch, to make contact with the end of the push button arm positioned in the slot extending horizontally through the door latch; with the opposite end of the chamber having an adjusting screw threaded into it, blocking the spring and used for adjusting the spring tension; with the total force needed to close both the door latch and push button latch shared by three springs in two separate actions instead of just by the two door latch springs, the host door can be closed easier and quieter with the push button kept in adjustment flush with the outside housing walls and maintain cooperating alignment between the push button catch and the end of the sliding latch of the combination lock.

4. The lock unit of claim 1 wherein the push button arm externsion describes a shallow arc on one of its vertical sides facing the center of the lock housing, so designed to enable it to clear the edge of an opening previously used for another type of lock in the host door.

5. The lock unit of claim 1 wherein the means for changing or setting the combination of the patented combination lock mounted in the unit housing, and previously needing a free tool to set by feel each of the dials of the lock, is improved by replacement in the present invention with push buttons extending on shafts from the dial mechanisms through spring wells in the unit housing; wherein when the push buttons are pushed to reset the dials, springs in the spring wells return the push buttons to their original neutral position.

6. The lock unit of claim 3 wherein the operation of the lock is improved by the addition of a handle attached to the door latch in the inside housing by the screw used for adjusting the sliding push pin spring, which is used by maintenance personnel who have access through the back of the locked unit, to open the door latch from the inside for resetting the dials.

7. The lock unit of claim 1 wherein the lock unit is designed to be able to be precisely placed on the host door to take advantage of an opening too small for a combination lock and previously made for a key type lock, so as to be a replacement for that lock if the key is lost.

8. The lock unit of claim 1 wherein the unlatching means comprises an inwardly directed swivally mounted push button arm, a door latch oppositionally positioned to the push button arm and spring biased to a closed position on the door jam; with a slot bisecting the center of the latch and having the inner end of the push button freely occupying the slot, wherein when the push button arm is pushed inwardly in a swival action it contacts an inner end face of the slot and urges the latch back from the door jam to an open position.

9. The lock unit of claim 7 wherein the door latch and the push button activating it automatically return to a closed or latched mode when released.

* * * * *